United States Patent [19]

Wyle et al.

[11] Patent Number: 4,536,935

[45] Date of Patent: Aug. 27, 1985

[54] APPARATUS FOR MOVING, HANDLING AND MOUNTING ATTACHMENTS ONTO A LENGTH OF FLEXIBLE MATERIAL

[75] Inventors: Charles Wyle, Los Angeles; Donald M. Shea, Torrance; Norman D. Best, Seal Beach, all of Calif.

[73] Assignee: Charles Wyle Engineering Corporation, Torrance, Calif.

[21] Appl. No.: 449,143

[22] Filed: Dec. 13, 1982

[30] Foreign Application Priority Data

Jun. 3, 1982 [SE] Sweden ..... 8203424

[51] Int. Cl.[3] ..... B25B 27/14

[52] U.S. Cl. ..... 29/281.1; 29/283; 29/428; 29/433; 29/720; 269/13; 269/238; 269/269; 269/287; 414/226

[58] Field of Search ..... 269/287, 238, 269, 13; 414/222, 223, 225, 226; 29/428, 720, 281.1, 283, 433; 226/118, 162

[56] References Cited

U.S. PATENT DOCUMENTS

| | | | |
|---|---|---|---|
| 918,816 | 4/1909 | Bartlett | 269/238 X |
| 2,840,895 | 7/1958 | Minock | 29/433 |
| 2,901,819 | 9/1959 | Schaffan | 29/433 X |
| 3,010,091 | 11/1961 | Sawyer | 29/433 |
| 4,345,963 | 8/1982 | Braber | 29/795 |

*Primary Examiner*—Howard N. Goldberg
*Assistant Examiner*—Ronald S. Wallace
*Attorney, Agent, or Firm*—Thomas I. Rozsa

[57] ABSTRACT

The present invention relates to a method and apparatus for handling any desired length of flexible material such as tubing in any desired mass production operation or in any simple operation where various lengths of flexible material such as flexible tubing must be handled and/or cut to any desired length. The present invention also relates to a method and apparatus for mounting attachments onto a length of flexible material such as tubing wherein any desired number of attachments can be quickly and efficiently mounted onto the tubing at any desired location or multiplicity of locations along the length of the flexible material including but not limited to at or adjacent the material ends.

40 Claims, 11 Drawing Figures

Fig. 2.
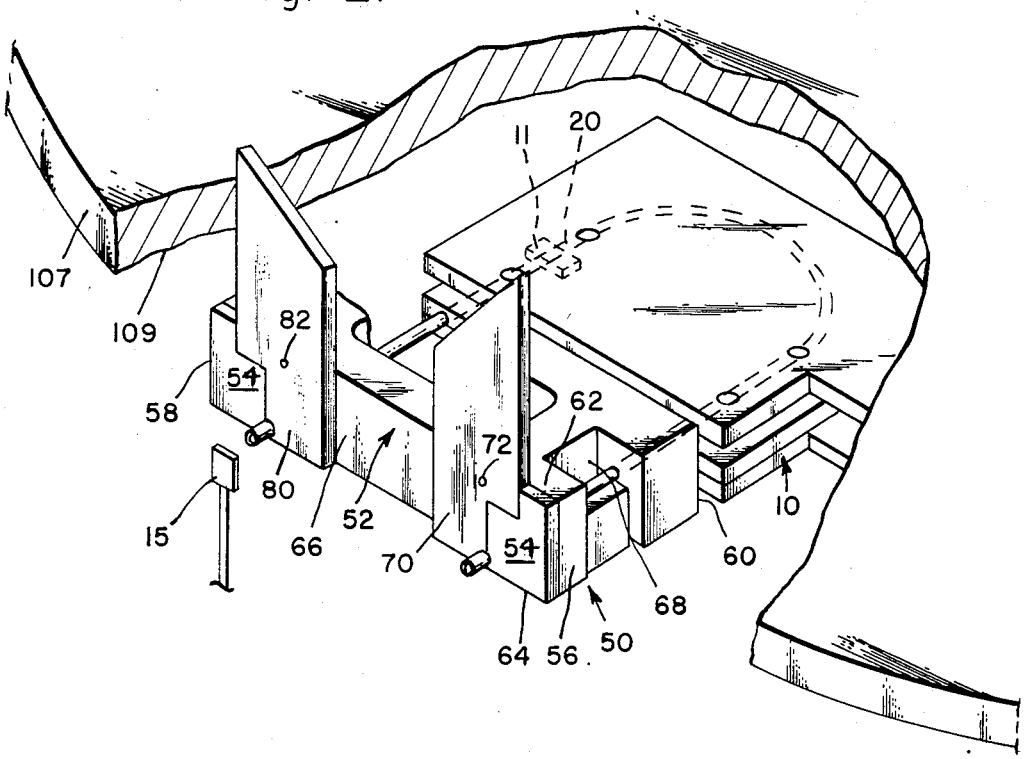
Fig. 3.
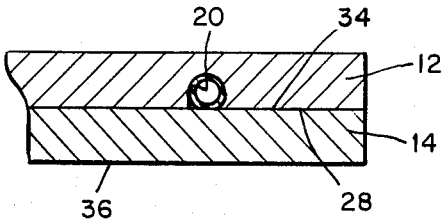
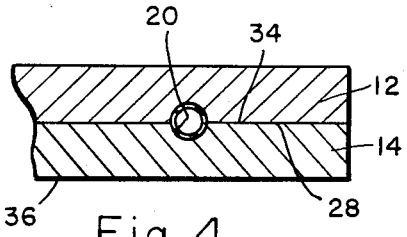
Fig. 4.
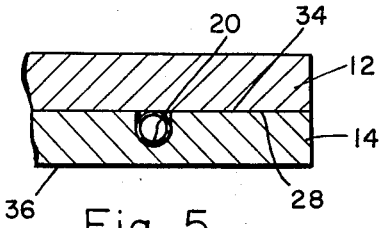
Fig. 5.

Fig. 6.
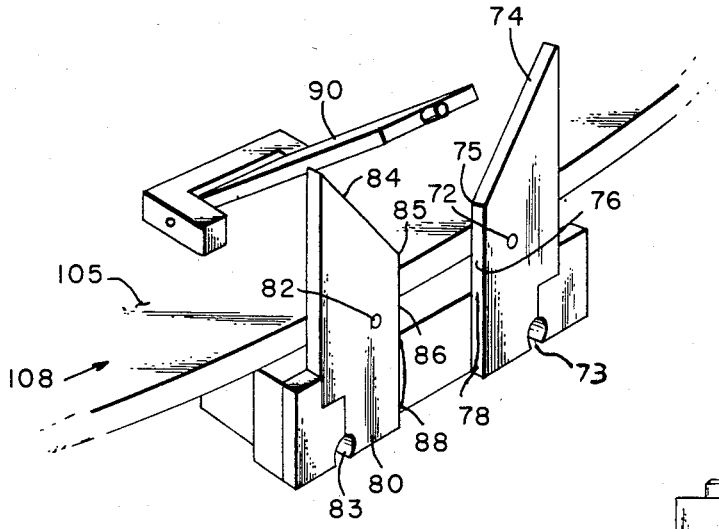
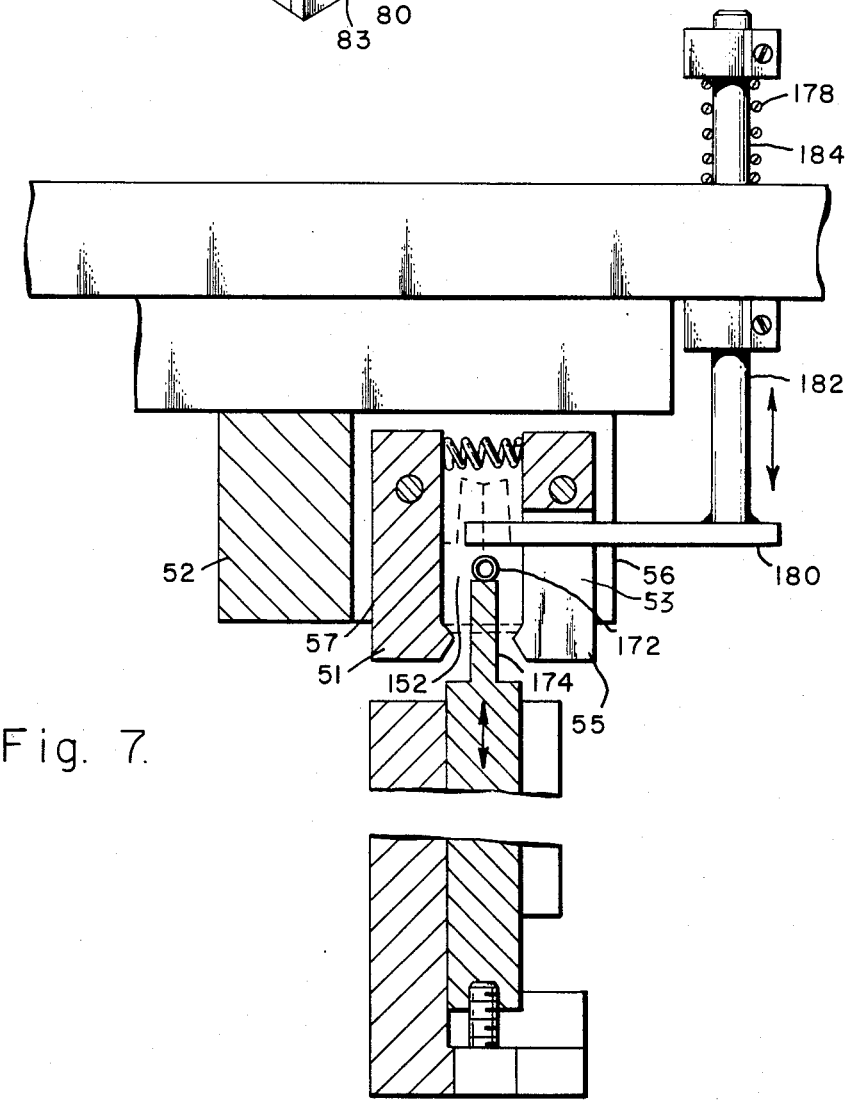
Fig. 7.

Fig. 10.
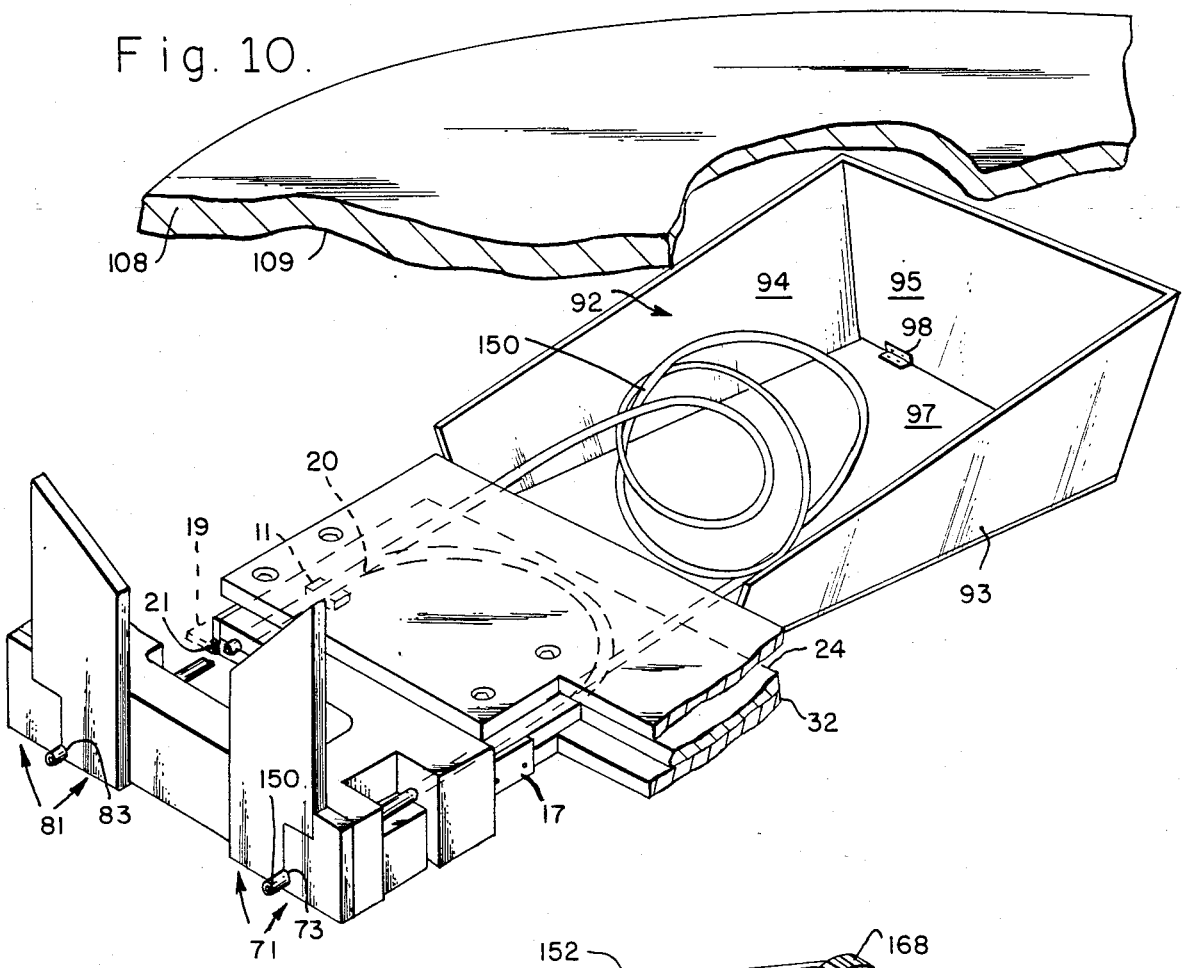
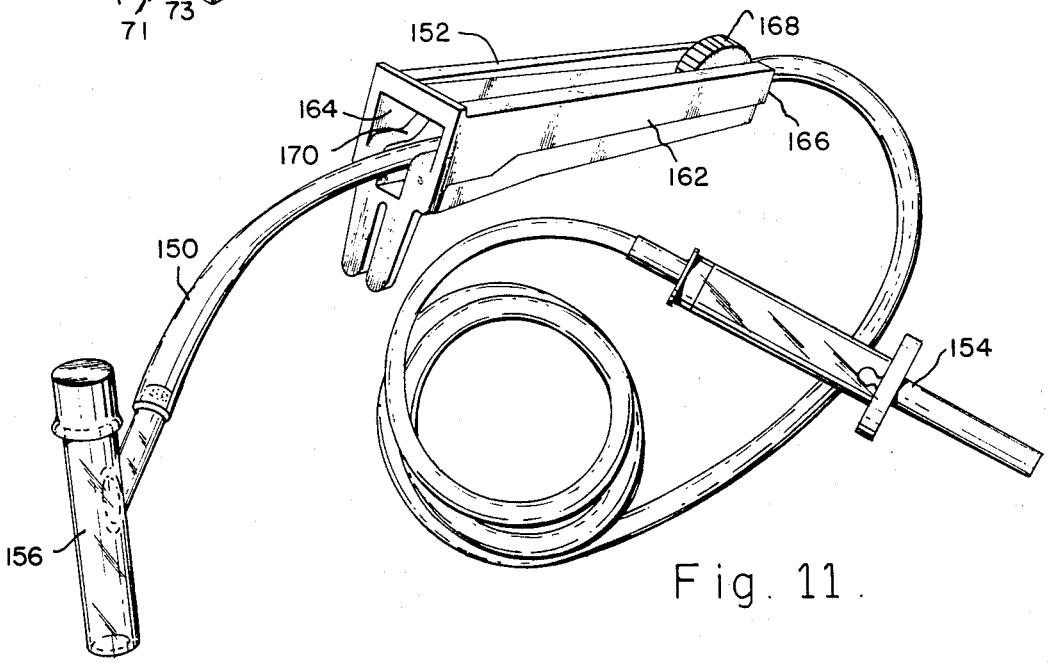
Fig. 11.

APPARATUS FOR MOVING, HANDLING AND MOUNTING ATTACHMENTS ONTO A LENGTH OF FLEXIBLE MATERIAL

BACKGROUND OF THE INVENTION

1. Field of the Invention

The present invention relates to a method and apparatus for moving, handling and mounting attachments onto a length of flexible material such as a length of tubing. One major problem encountered when handling flexible material such as tubing in a mass production operation is that the flexible material does not have sufficient rigidity to permit it to be pushed into and out of various areas and further does not have sufficient rigidity to permit it to be pushed onto or through various objects which must be attached onto the tubing. The present invention provides a unique method and several alternative apparatus embodiments for enabling a length of flexible material such as flexible tubing to be pushed for a specific distance and further enables the flexible material to be pushed into or onto various components which can thereby be attached to the tubing at any desired location along its length. One specific application for the present invention is its use as part of automatic machinery which can assemble units that must utilize a length of flexible tubing as part of the assembly.

2. Description of the Prior Art

Prior art applications for handling a length of flexible material such as tubing in mass production machine operations involves a very complex system of interrelated pulleys and levers which string the tubing along a chain of various paths in order to drive it through the machine until a proper length has been measured. At that time, the tubing is then cut. Numerous problems are encountered with the prior art applications. Due to the required complexity of the various mechanical systems for pulling the tubing, an excessive amount of friction is built up along the pulleys and therefore the length of tubing which can effectively be handled is limited. Since the tubing is strung in a wide-open manner, there is substantial opportunity for it to become entangled in various parts of the machine or to coil and tangle within itself. Since the tubing is pulled over and along many mechanical parts, there is substantial opportunity for it to become dented or scratched. All of the prior art methods use a series of mechanical parts which pull the flexible material such as tubing and therefore, there is no effective method to attach components at locations other than the two ends of the tubing. None of the prior art applications disclose any method by which the flexible material can be pushed to thereby enable it to be pushed onto or into components which must be attached along its length at locations other than the two ends.

Therefore, the prior art does not disclose any method or apparatus by which any desired length of tubing can be effectively and efficiently handled and which permits the length of flexible material such as tubing to be pushed onto or into various components such that the components can be placed at any desired location along the length of the material.

SUMMARY OF THE PRESENT INVENTION

The present invention relates to a method and apparatus for handling any desired length of flexible material such as tubing in any desired mass production operation or in any simple operation where various lengths of flexible material such as flexible tubing must be handled and/or cut to any desired length. The present invention also relates to a method and apparatus for mounting attachments onto a length of flexible material such as tubing wherein any desired number of attachments can be quickly and efficiently mounted onto the tubing at any desired location or multiplicity of locations along the length of the flexible material including but not limited to at or adjacent the material ends. The present invention also relates to a method and apparatus for enabling any desired length of tubing to be handled, cut and carried in a mass production machinery operation while assuring that the material will not become scratched, dented, or entangled either within itself or any portion of the machine. The novel method and apparatus permit any desired length of tubing to be so handled without requiring any increase in size of the operating mass production machine.

It has been discovered, according to the present invention, that any non-rigid flexible material such as tubing can be effectively handled and pushed if it is confined and not permitted to buckle along the path of movement.

It has further been discovered, according to the present invention, that any non-rigid material which is confined and not permitted to buckle along its path of movement can be thereby pushed through any desired number of components or apparatuses such that the components or apparatus can thereby be located at any desired length along the flexible material.

It has also been discovered, according to the present invention, that if the flexible material such as tubing is caused to move through a two part structure in the form of a sandwich which contains an internal groove or path whose cross-sectional dimension is slightly larger than the cross-sectional dimension of the flexible material, then the flexible material will not buckle as it moves through the groove or path in the sandwich structure and therefore may be pushed through the sandwich structure. The material can then be removed by separating the two sections of the structure.

It has additionally been discovered, according to the present invention, that if one or more gripping members is placed at a location in front of the two part sandwich structure containing an internal groove, and each gripping member further contains an opening which is aligned with the groove in the sandwich structure, then the flexible material can also be pushed through the gripping members as well as the sandwich structure. Further, if the gripping members can be set such that the opening within is either in a slightly cracked open position or a closed position, then the gripping member will permit the flexible material to be pushed through it when its opening is in the cracked open position and the gripping member will grip the leading and trailing ends of the flexible material when its openings are in the closed position. It has additionally been discovered that if the gripping members contain any desired number of components, each of which contain an opening or groove aligned with the opening in the gripping members and with the groove in the sandwich structure, then the flexible material can also be pushed through the components as well as the gripping members and the sandwich. As a result, a number of components can be located at any desired position along the length of the flexible material.

It has also been discovered, according to the present invention, that if the outermost gripping member is set such that the jaw section of the gripping member receiving the leading end of the flexible material can be set in a closed position after it receives the flexible material while the jaw section of the gripping member at the trailing end of the flexible material is permitted to remain the cracked upon position, and the sandwich section is caused to separate after the leading end of the flexible material has been gripped, then any desired length of flexible material can be caused to be fed into the separated structure and therefore any desired length of flexible material can be handled by the present invention. Additionally, if a receiving member such as a pocket is located directly behind the two part sandwich structure, it has been discovered, according to the present invention, that the excess length of tubing will fall into the receiving member and will be carried therein. After the desired length of tubing has been fed, the jaw of the gripping member at the trailing end of the flexible material can also be set to the closed position and the material properly cut. As a result, the present invention permits any desired length of tubing to be fed and also provides an apparatus and method for receiving the excess length of material and carrying it to thereby assure that it will not become scratched, dented, or tangled in any components of the mass production machine.

It is therefore an object of the present invention to provide a method and apparatus for handling any desired length of flexible material such as tubing in any desired mass production operation or in any simple operation where various lengths of flexible material such as flexible tubing must be handled and or cut to any desired length.

It is another object of the present invention to provide a method and apparatus whereby the flexible material such as flexible tubing can be pushed for any desired length.

It is a further object of the present invention to provide a method and apparatus for mounting attachments onto a length of flexible material such as tubing wherein any desired number of components can be quickly and efficiently mounted onto the flexible material at any desired location or multiplicity of locations along the length of the flexible material.

It is also an object of the present invention to provide a method and apparatus for enabling any desired length of tubing to be handled, cut and carried in a mass production machinery operation, while assuring that the material will not become scratched, dented, or entangled either within itself or in any portion of the machine and further that any excess length of material will be carried within a receiving means.

Further novel features and other objects of the present invention will become apparent from the following detailed description, discussion and appended claims, taken in conjunction with the drawings.

DRAWING SUMMARY

Referring particularly to the drawings for the purpose of illustration only and not limitation there is illustrated:

FIG. 2 is a detailed perspective view of the present invention disclosing a two part sandwich structure and a gripping means with related movable jaws.

FIG. 3 is a partial cross-sectional view of the two part sandwich structure with the groove or opening located entirely in the upper half of the sandwich structure.

FIG. 4 is a partial cross-sectional view of the two part sandwich structure with the groove or opening located partially within the upper half of the sandwich structure and partially within the lower half of the sandwich structure.

FIG. 5 is a partial cross-sectional view of the two part sandwich structure with the groove or opening located entirely within the lower half of the sandwich structure.

FIG. 6 is a perspective view of the jaw opening and closing means associated with the gripping members.

FIG. 7 is a cross-sectional view of the inserting and gripping members for the roller clamp, disclosing its internal components and related components used with the gripping members.

FIG. 10 is a partial perspective view of the gripping means, two part sandwich structure, and optional receiving means.

FIG. 11 is a perspective view of a complete assembly, disclosing a roller clamp placed onto the tubing and a drip chamber assembly and injection site subassembled placed onto respective ends of the tubing.

DETAILED DESCRIPTION OF THE PREFERRED EMBODIMENT

Figure 1:
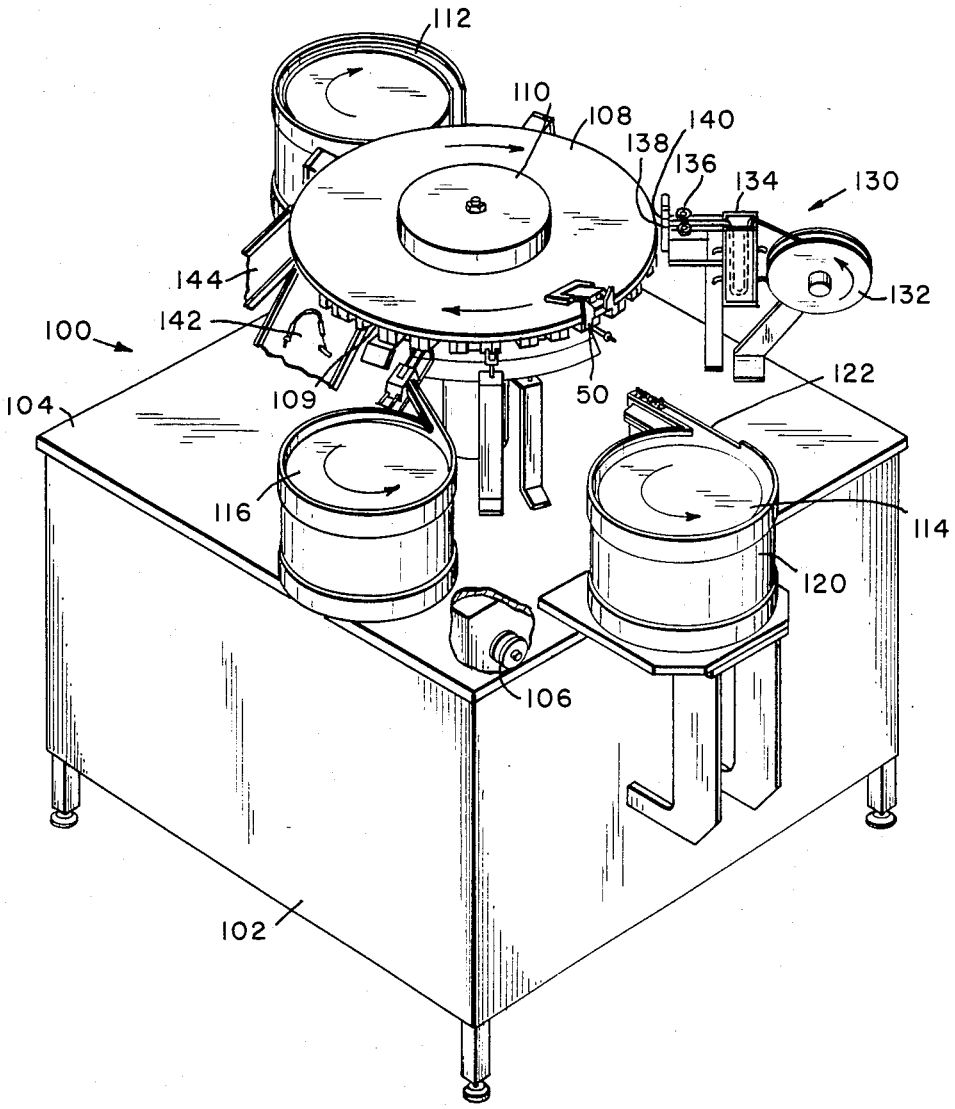
FIG. 1 is a partial perspective view of a mass production machine which is used to feed and handle lengths of flexible material and attach components onto various portions of the length of the material and onto its ends.

The present invention is shown in detail in FIGS. 2 and 10; however, for purposes of clarification, the present invention is shown in use in conjunction with an automatic assembly machine in FIG. 1.

The automatic assembly machine 100 shown in FIG. 1 can be used to assemble various components onto a length of flexible material such as flexible tubing. In one application, the assembly machine 100 can be used to assemble the various components which are utilized in conjunction with intravenous feeding of fluids and antibiotics. An example of such a subassembly unit is shown in FIG. 11. The subassembly consists of a length of flexible tubing 150 which may have a flow restrictor such as a roller clamp 152 assembled onto the tubing 150. Other components such as a drip chamber 154 is assembled onto one end of the tubing and another component such as an injection site subassembly 156 is assembled onto the other end of the tubing.

The automatic assembly machine 100 can be a rotary indexing assembly machine as shown in FIG. 1. In general, the machine must perform the following functions: (1) Feed tubing from a coil and cut it to the appropriate length, while retaining control of the cut ends; (2) Feed molded components such as flow restrictors, drip chambers and injection site subassemblies from bulk, orient them, and position them for assembly; (3) Mount appropriate components such as a flow restrictor onto the cut length of tubing at the appropriate location or locations; (4) Apply solvent to the tubing ends; (5) Mount other appropriate components such as the drip chamber or the injection site subassembly onto the respective cut ends of the length of tubing; and (6) Place the completed assembly into an area where it can be removed from the machine.

The present invention incorporates a novel apparatus and method for handling any desired length of flexible tubing and enabling appropriate components to be assembled onto the tubing at any desired location or locations and also at the tube ends.

As previously mentioned, an example of an automatic assembly machine with which the present invention can be used is shown in FIG. 1. In general, the machine 100 comprises a rotary indexing dial on a welded base, which supports the operating stations distributed around the dial. More specifically, the machine 100 contains a base 102 which has a top plate 104. The base 102 supports a barrel-cam indexing drive 106 beneath the top plate 104 and an associated shaft (not shown) for mechanical motions of operating stations. At the approximate center of the top plate 104 and supported at a distance above said top plate is a rotary indexing dial 108. By way of example only, the rotary indexing dial 108 can be approximately 16 inches above the top plate 104. A mechanical overload device 110 is located on top of the rotary indexing dial 108. On its lower surface 109, the rotary indexing dial supports a multiplicity of assembly fixtures. These will be described in more detail later on.

Located around the assembly machine 100 and attached either directly or indirectly to the top plate 104 as shown in FIG. 1 are a multiplicity of feed stations which are used to feed the components into position for assembly. Three such feed stations are illustrated in FIG. 1. By way of example, they can be utilized as a roller clamp feed stations 112, a drip chamber feed station 114, and an injection site feed station 116. In one example, each of the feed stations has associated therewith (as most clearly illustrated with drip chamber feed stations 114) a vibratory bowl 120, a vibratory track 122, a timed part release device (not shown) and a vertically reciprocating plunger (not shown) which is used to insert each component into the appropriate area adjacent or underneath the rotary indexing dial 108.

A flexible tube feeding station 130 is located at one portion of the assembly machine 100 and is supported by the top plate 104. In one embodiment, the tube feeding station 130 comprises a powered pay off reel 132, a dancer system 134 to control tension in the flexible tubing, controlled-feed pinch rolls 136, a tube guiding track 138 and a cut-off device 140 for cutting the tubing after the appropriate length has been fed.

A discharge chute for accepted parts 142 and for rejected parts 144 is located below the dial and not attached to it, for the purpose of discharging the completed assemblies from the machine base for further processing from which they will be removed from the machine.

The assembly machine 100 also contains other detailed components which have not been shown such as photocell sensing devices, reciprocating plungers, pneumatic and vacuum systems, electrical controls and guards and safeties. The purpose of the above description of the assembly machine is to provide an illustration of one-type of machine with which the present invention can be utilized and is by no means intended to limit the application of the present invention to this machine.

Figure 8:
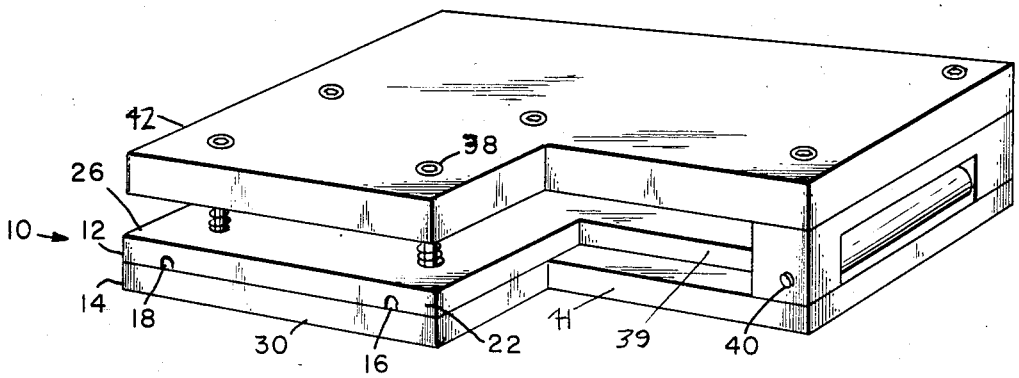
FIG. 8 is a perspective view of the two part sandwich structure with optional retaining plate containing knockout pins.
Figure 9:
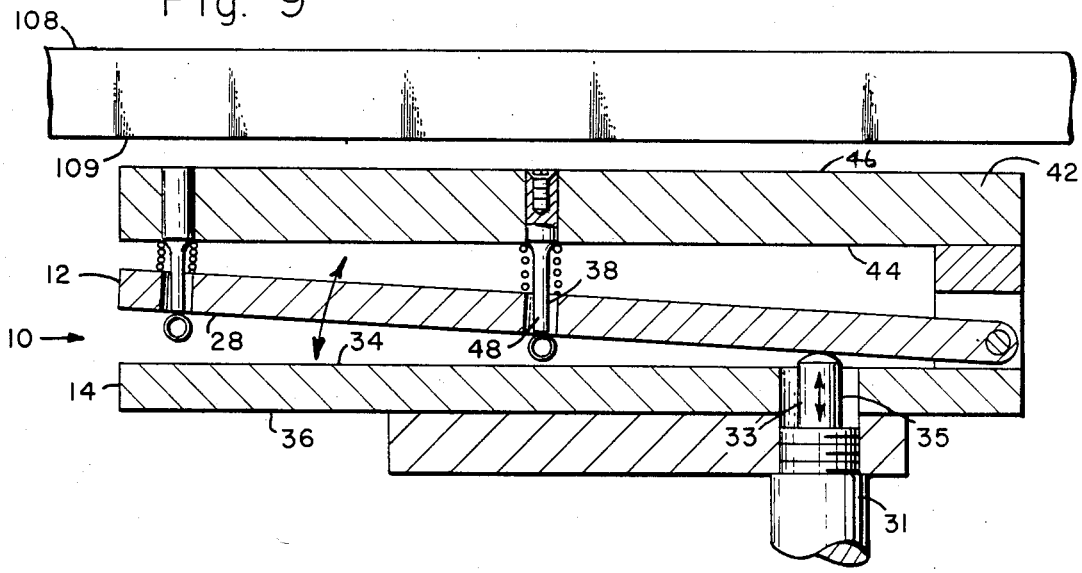
FIG. 9 is a cross-sectional view of the two part sandwich structure with optional retaining plate containing knockout pins, with the upper section of the sandwich structure raised.

A more detailed view of one embodiment of the present invention is shown in FIGS. 2, 8, and 9. One portion of the present invention comprises a two part structure 10 formed of a pair of substantially rectangular plates which fit together to form a sandwich structure. In the embodiment disclosed in the figures, the two plates are substantially horizontally disposed. In the two part structure 10, the first or upper sandwich member or section 12 and the second or lower sandwich member or section 14; have approximately the same dimensions and form. First sandwich member 12 has a front edge 22, a rear edge, an upper surface 26 and a lower surface 28. Similarly, second sandwich member 14 has a front edge 30, a rear edge, an upper surface 34 and a lower surface 36. Extending within the two part sandwich structure 10 is a curved channel or groove 20 which begins at the front face of the sandwich structure 20 at first opening 16 and terminates at the front face of the sandwich structure 10 at second opening 18 which is at a location spaced apart from the first opening 16, to thereby form a curved channel within the two part sandwich structure 10. The curved channel 20 can be located in one of three alternative positions. In the preferred embodiment shown in the cross-sectional view of FIG. 3 the entire curved channel 20 is located within upper sandwich member 12 and adjacent its lower surface 28 such that the upper surface 34 of second or lower sandwich member 14 is completely flat and forms the lower extremity of curved channel 20 when the two sandwich members are brought together. In an alternative embodiment shown in the cross-sectional view of FIG. 4, the curved channel 20 is located partially within upper sandwich member 12 and adjacent its lower surface 28 and partially within lower sandwich member 14 and adjacent its upper surface 34 such that the channel or groove 20 is formed completely only when the two parts come together. Finally, in a third alternative embodiment shown in FIG. 5, the entire channel or groove 20 is located within lower sandwich member 14 and adjacent its upper surface 34 such that the lower surface 28 of upper sandwich member 12 forms the upper extremity of the channel 20 when the two parts of the sandwich are brought together. As will be explained in more detail later on, the preferred embodiment is to have the entire groove or channel within upper sandwich member 12 as shown in FIG. 3.

The channel or groove 20 is shown as having a cross-section of generally horse-shoe shaped configuration. It is emphasized that this is only one possible design and the cross-section of the channel 20 can be any shape to accommodate the shape of the object to be placed through it.

As shown in FIG. 2, the two part sandwich structure 10 is positioned beneath the rotary index dial 108 at a location opposite the tube feeding station 130 such that the front edges 22 and 30 of the sandwich members faces the tube feeding station. The lower sandwich member 14 is supported by posts (not shown) which attach the lower sandwich member to the top plate 104 and at a location elevated above the top plate. Initially, the upper sandwich member 12 rests on top of the lower sandwich member 14. As shown in FIG. 9, an air cylinder 31 and a plunger 33 associated with it are located beneath and to one side of the sandwich structure. The plunger 33 protrudes through an opening 35 in lower sandwich member 14 such that it can force upper sandwich member 12 upwardly and away from lower sandwich member 12 at the appropriate time. In one embodiment, upper sandwich member 12 can rotate about pin 40 which is positioned at a distance from the sandwich structure 10. The sandwich structure is provided with upper extension 39 and lower extension 41 to accommodate this apparatus. The sandwich structure 10 is therefore positioned below the top plate 104 such that there is sufficient clearance between the upper surface 26 of top sandwich member 12 and the lower surface 109 of the rotary index dial 108 to enable the upper sandwich member 12 to be elevated above the lower sandwich member 14.

The sandwich structure 10 can also comprise an optional feature which is a stripper plate 42 rigidly attached to the sandwich structure 10 and spaced apart from the upper surface 26 of upper sandwich member 12. This is best illustrated in FIGS. 8 and 9. Rigidly attached to the stripper plate 42 and protruding downwardly from its lower surface 44 are a multiplicity of knock-out pins 48. As best illustrated in FIG. 9, each knock-out pin 48 protrudes through one of a multiplicity of openings 38 in the upper surface 26 of upper sandwich member 12. The openings 38 extend through the entire thickness of upper sandwich member 12. When upper sandwich member 12 is raised by means of plunger 33, the rigid knock-out pins can come into channel 20. In the preferred embodiment, the knock-out pins 48 are designed such that they will not extend beyond the lower surface 28 of upper sandwich member 12 when the upper sandwich member 12 is in its uppermost position. Although there are several methods by which upper sandwich member 12 can be raised, one preferred form is to have it rotate about pin 40 as previously described. There is naturally sufficient clearance between the upper sandwich member 12 and the stripper plate 42 to permit the upper sandwich member 12 to be elevated above the lower sandwich member 14. There is also sufficient clearance between the lower surface 109 of indexing dial 108 and the stripper plate 42 to permit the dial 108 to rotate without comming in contact with the upper surface 46 of stripper plate 42. As shown in FIGS. 2, 8 and 9, the knock-out pins 48 are located on both sides of the sandwich structure, in line with first and second openings 16 and 18, respectively. As shown in FIG. 9, the knock-out pins 48 are designed to extend as far as the lower surface 28 of upper sandwich member 12 when the upper sandwich member 12 is in its raised position. Therefore, the knock-out pins 48 on the left side are shorter than the knock-out pins on the right side.

Associated with the sandwich structure 10 are a multiplicity of tube gripping members 50. In the preferred embodiment as shown in FIG. 1, each of the tube gripping members 50 is rigidly attached to the lower surface 109 of the rotary index dial 108 such that the forward edge 54 of each tube gripping member 50 is approximately parallel to circumference 107 of the rotary index dial 108. It is within the spirit and scope of the present invention to have the forward edge 54 either extending slightly beyond or else recessed slightly behind the circumference 107 of the rotary indexing dial 108.

A perspective view of the gripping member 50 is illustrated in FIGS. 2 and 10. In the preferred embodiment, the gripping member 50 consists of a main frame 52 which has a forward edge 54, first and second sides 56 and 58 respectively, a rearward edge 60, an upper surface 62 and a lower surface 64. The main frame 52 contains a first substantially rectangular external recess 66 extending through the height of the main frame 52 and further extending inwardly from forward edge 54. In the preferred embodiment, the main frame 52 also contains a second substantially rectangular recess 68 extending inwardly from first side 56 and also extending through the entire height of the main frame 52. It is also within the spirit and scope of the present invention to have a third substantially rectangular recess comparable to the second substantially rectangular recess extending inwardly from second side 58. The upper surface 62 is rigidly attached to the lower surface 109 of the rotary indexing dial 108, such that the forward edge 54 is substantially parallel to the circumference 107 of the rotary indexing dial.

Contained within recess 66 and on opposite sides of said recess 66 are a pair of movable jaw members, 70 and 80, respectively. First movable jaw 70 is positioned adjacent one side wall of said first recess 66 to form a right or first clamp set 71 with the body portion of said main frame 52 adjacent said first edge 56. Similarly, left or second movable jaw 80 is positioned adjacent the second side wall of said first recess 66 to form left or second clamp set 81 with the body portion of said main frame 52 adjacent said second edge 58. A first groove or channel 73 extends through the entire thickness of said main body 52 between first movable jaw 70 and the body portion of said main frame 52 adjacent first side 56. The first groove or channel 73 also extends as described on both sides of second recess 68. Similarly, a second groove or channel 83 extends through the entire thickness of said main body 52 between said second movable jaw 80 and the body portion of said main frame 52 adjacent second side 58.

The body portions of the main body 52 and the first and second movable jaws 70 and 80 thereby form right and left clamp sets 71 and 81 respectively which can accommodate tubing within first and second chambers 73 and 83 respectively. In the preferred embodiment, the right and left clamp sets are bi-stable and can be positioned in any one of three settings; a completely closed position, a "cracked-open" position wherein each movable jaw is spaced slightly apart from its adjacent main frame body portion such as approximately 10/1000ths of an inch, and an open position wherein each movable jaw is spaced wide apart from its adjacent main frame body portion.

In the preferred embodiment, the right and left clamp sets 71 and 81 are spring loaded into closed position except when forced partially or fully open when so set by an external force. Movable jaw 70 pivots around horizontal radially extending pin 72 which is mounted in the main frame 52. Movable jaw 80 pivots around horizontal radially oriented pin 82 which is mounted in the main frame 52. One embodiment of an apparatus for achieving this result is shown in the enlarged view in FIG. 6. Movable jaws 70 and 80 extend vertically upward beyond the upper surface of indexing dial 108. Movable jaw 70 has an inclined inwardly extending interior edge 74 on its upper portion and movable jaw 80 similarly has an inclined inwardly extending interior edge 84 on its upper portion. At its lowermost point 75, inclined surface 74 becomes a straight approximately vertical surface 76, terminating at its lowermost point 78. Similarly, at its lowermost point 85, inclined surface 84 becomes a straight approximately vertical surface 86, terminating at its lowermost point 88. A transverse jaw opening means such as lateral plunger 90 is located on the upper surface 105 of indexing dial 108, spaced apart from and midway between the two jaws 70 and 80. When the lateral plunger 90 rests on the uppermost portions of inclined surfaces 74 and 84, the jaws 70 and 80 are in the closed position. When the plunger is moved downward along inclined surfaces 74 and 84, movable jaw 70 pivots in a clockwise direction about hinge pin 72 and movable jaw 80 pivots in a counter-clockwise direction about hinge pin 82 and the two jaws are then in the cracked-open position. When the plunger 90 moves to lowermost points 75 and 85, the jaws are moved to the fully opened position. The plunger 90 can be slid along vertical surfaces 76 and 86 to lowermost points 78 and 88 to retain the jaws 70 and 80 in the opened position. The right and left clamp sets 71 and 81 are arranged to position tubing ends to protrude slightly beyond the periphery of radial indexing dial 108. When the jaws are in the closed position, they grip tubing 150 securely in channels 73 and 83. When the jaws are in the "cracked-open" position, they allow the tubing 150 to pass through first and second channels 73 and 83 respectively and also serve to guide the tubing 150 through the channels. When the jaws 71 and 81 are in the open position, the tubing 150 can drop out of the jaws 71 and 81.

The operation of the automatic assembly machine utilizing the two part sandwich 10 and the gripping member 50 will now be described. By way of example only, there can be 16 individual gripping members 50 located at evenly spaced locations around the lower surface of the radial indexing dial and adjacent its periphery. By way of example, the present two part sandwich 10 and the gripping member 50 will be used to place a flow restrictor such as a roller clamp 152 illustrated in FIG. 11 onto a portion of a length of tubing adjacent one of its ends. As shown in the perspective view of FIG. 11, the roller clamp 152 is comprised of an elongated hollow body member 162 which is open at both ends 164 and 166 respectively and accommodates a roller 168 along an inclined internal track 170. When the roller 168 is moved to its lowermost position adjacent large end 164, a clear passage or open longitudinal channel 172 is created from one end of the roller clamp to the other, and a tube 150 may be pushed through the roller clamp 152. In operation, the roller would be moved downwardly along the internal track 170 to thereby restrict the flow of material running through the tubing placed into the roller clamp. The bottom along which the roller 170 moves is open while the top is closed. The roller clamp 152 is shown upside down in FIG. 11. The roller clamp 152 is oriented in a vibratory bowl and discharged in a vibratory track, with the large end 164 leading and the open bottom down. The roller clamp 152 travels along the track to an escapement immediately inboard of the two clamp sets 71 and 81 on the gripping body 50. The rotary indexing dial 108 rotates by a predetermined amount to bring the right clamp set 71 consisting of movable jaw 70 and the body member adjacent edge 56 of the gripping member 50 into alignment above the properly oriented roller clamp 152. As shown in FIG. 7, the right clamp set 71 indexes into position, a vertically reciprocating plunger 172 pushes the lead roller clamp 152 up into spring loaded shelves 51 behind movable jaw 70 and the body portion of gripping body 50 adjacent side 56. The spring loaded shelf 51 has a right half 55 and left half 57. The roller clamp 152 flexes the shelves 51 apart and allows them to snap into position as it seats within the right clamp set 71. The body of the roller clamp is partially within recess 68 and is oriented within right clamp set 71 such that its open longitudinal channel 172 is aligned with and intermediate between groove 73 in the front and rear portions of the gripping member 50. As further shown in FIG. 7, a spring actuated Clamp Stripper Plate 180 extends transversely into the right spring loaded shelf 55 behind the body portion of gripping body 50 adjacent side 56. The clamp stripper plate is supported by post 182 which in turn is supported by a spring 178 and plunger 184. The clamp stripper plate 180 rests on top of roller clamp 152. As shown in FIG. 7, the right shelf 55 has a vertical opening 53 which would permit the clamp stripper plate 180 to move downwardly. At the appropriate time after the tubing has been assembled onto the roller clamp and all other operations are completed, the plunger 184 and spring 178 will cause the clamp stripper plate 180 to move downwardly, thereby pushing the roller clamp 152 out of the opened jaws 71.

As the indexing dial continues to rotate, it indexes into position such that the front edge 54 of the gripping member faces the tube feeding assembly 130 and is positioned such that groove 73 is in alignment with the length of tubing 150 being fed from the tube feeding assembly 130 while at the same time the rear face 60 of the gripping member 50 is aligned with the stationary two part sandwich structure 10 such that the rear opening of groove 73 is aligned with the first opening 16 of groove 20 within the sandwich structure 10 while the rear opening of groove 83 in the gripping member 50 is aligned with the second opening 18 of groove 20 in the sandwich structure 10. The clearance between the gripping member 50 and the incoming tube on its front face is very narrow, and by way of example can be 30–60/1000ths of an inch. The clearance between the rear face 60 of gripping member 50 and the stationary sandwich 20 is very narrow, and by way of example can be 30–60/1000ths of an inch.

Two reciprocating plungers (not shown) extend into position and cause the lateral plunger 90 to move downward on surfaces 74 and 84, thereby causing right and left clamp sets, 71 and 81 respectively, to go from the closed position to the "cracked-open" position. In this position, movable jaws 70 and 80 are caused to rotate about their respective hinge pins 72 and 82 and rotate inwardly and away from their respective adjacent fixed main body member 52. Simultaneously, a vertically reciprocating plunger raises a carefully shaped shelf (not shown) into the open bottom of the roller clamp 152, thus completing a guide track through the roller clamp. If required, a device (not shown) engages the roller 168 in the roller clamp 152 and moves it to its lowermost position to thereby assure an open channel 172 within the roller clamp 152 for tube passage. The device may also spin the roller 168 to also assist in pulling the tubing 150 through the channel 172 in the roller clamp 152.

The flexible tube 150 is then caused to move on the flexible powered pay off reel 132, pass through the dancer system 134, pass between the pinch rolls 136, pass through the guiding track 138 which is in alignment with groove 73, pass through groove 73 in the first clamp set 71 and thereby also pass through the channel 172 in the roller clamp 152, pass into groove 20 in the sandwich structure 10 through first opening 16, pass through the entire arc of groove 20 and passes out of groove 20 through the second opening 18 and into groove 83 from the rear in the left clamp set 81 and out the front of groove 83. A sensor 11 in upper sandwich member 12 and aligned with groove 20 senses the tubing just before it exits groove 20, and this causes the tube feeding station 130 to stop feeding tubing 150. It is necessary to sense the tubing prior to exit in order to mechanically stop the tube feeding at the time of exit from the gripping body channel 83. This is due to the rapid travel of the tube 150 and the few millisecond delay required for the mechanical powered pay-off system 130 to be stopped. As an additional optional feature, a mechanical barrier such as wall 15 can be fixed in a position in front groove 83 in order to assure that the rapidly moving tubing 150 will be stopped at the right position. The barrier 15 can be independently supported from top plate 104. The jaws 70 and 80 then move to the closed position to grip the tubing 150 and the tubing is cut by the cut-off device 140. The shelf and the spinning device if used are retracted downward to clear the roller clamp 152. The plunger 33 causes the upper sandwich member 12 to move upwardly and away from the lower sandwich member 14. The rotary index dial 108 then begins to rotate and the gripping member 50 carries the length of tubing 150 with the roller clamp 152 inserted to the next station. It will now be understood that as previously described, the preferred embodiment calls for the channel 20 to be entirely within the upper sandwich member 12. In this way, after the upper sandwich member 12 has been elevated away from the lower sandwich member 14, the length of tubing 150 rests upon the flat upper surface 34 of the lower sandwich member and the tubing can be easily slid off and travel around the dial 108 while its ends and the now attached roller clamp 152 are held by the gripping member 50. The next gripping member 50 is brought into alignment and the process is repeated. One problem that may be encountered is that the tubing 150 will stick within the groove 20 after the upper sandwich member 12 is raised away from lower sandwich member 12. Therefore, the optional feature of the stripper plate 42 which contains the knockout pins 48 can be utilized. As previously described, when the upper sandwich member 12 moves away from lower sandwich member 14, the stationary stripper plate 42 causes the stationary knockout pins 48 to move into channel 20 and thereby knock the tubing out of the channel 20. In this way, the tubing rests on the flat upper surface 34 of lower sandwich member 14 and can easily be slid off as the dial indexes around.

It will readily be seen that through utilization of the novel two part sandwich structure 10 used in conjunction with the gripping body member 50, any desired length of flexible tubing 150 can be handled on a mass production basis with one or more components attached to the tubing 150. It if is desired to attach another component adjacent the other end of the tubing 150, an apparatus similar to the mechanisms previously described could be attached to be in alignment with groove 83 in the gripping body member 50. If it is desired to align a multiplicity of components one after the other on the same side of the tubing, then a multiplicity of gripping body members 50 could be employed and positioned radially inward, one after the other, to thereby grip the different components. The novel two part sandwich structure 10 would then have to be positioned further inward so that it would clear the rear face of the innermost gripping member 50.

The groove 20 within the sandwich structure 10 can be semicircular or else generally horse-shoe shaped. It will be appreciated that the length of the tubing 150 that can be handled by the above described invention is therefore limited by the overall length of the channel or groove 20 within the sandwich structure 10. It is within the spirit and scope of the present invention to provide a multiplicity of interchangeable different size sandwich structures that have different lengths of grooves 20 to accommodate different needs. There is, however, an upper limit to the length of tubing which can be handled by this embodiment due to the physical size of the machine 100 and therefore the physical size of the sandwich structure 10 it can handle.

An important concept of the present invention is that flexible material such as flexible tubing 150 can be pushed and fed through parts such as the flow restrictor 152 if the tubing is confined and not permitted to buckle. The channels 73 and 83 in the gripping body member 50 and the channel 20 in the sandwich structure 10 provide this appropriate confined space to permit the flexible tubing to be pushed. The cross-sectional area of the channel or groove 20 has been described as being slightly larger than the cross-sectional area of the flexible tubing or flexible material 150 to be pushed through the channel or groove 20. By way of example, the diameter of the channel 20 could be approximately 8/10,000ths to 10/10,000ths of an inch larger than the diameter of the flexible tubing or flexible material 150. If the flexible tubing or flexible material 150 is of a cross-sectional configuration other than circular, then the cross-sectional distance of the channel 20 should be approximately 8/10,000ths to 10/10,000ths of an inch larger in each direction than the corresponding cross-sectional distance of the flexible material or flexible tubing 150.

As just described, there is an upper limit to the length of tubing that can be pushed in this manner. The first reason for the limit is that the size of the sandwich structure 10 becomes prohibitively large after a certain size. The second reason is that beyond a certain length, the friction within the channel 20 becomes objectionably high. Although there is no precise length at which the above problems occur, it is generally felt that a tubing length is approximately 36 inches is the approximate practical upper limit for use with the above described embodiment. However, it has also been discovered, that with the addition of a pocket member and a slightly different method of utilizing the sandwich structure 10, the above apparatus can be used to handle any desired length of tubing whatsoever. This alternative embodiment will now be described.

The modification in the apparatus and method is illustrated in FIG. 10. The sandwich structure 10 is modified as follows.

A transverse wall 17 is located on the side of the sandwich adjacent where the tubing enters. Since the tubing entered adjacent the right side of the sandwich 10, the wall 17 is also there. The wall 17 is shown as fixed to the lower sandwich member 14, but this is only one alternative embodiment. In other embodiments, the wall 17 can be fixed to upper sandwich member 12 or else it can be rotatable wall which can rotate to a horizontal position. The sandwich structure 10 also may contain a movable wall 19 which is located on the side of the sandwich adjacent where the tubing exits. As shown in FIG. 10, this movable wall 19 rotates about pin 21 and can rotate to a horizontal position (shown in phantom).

The modification in the method for intermediate lengths of tubing is as follows. The initial steps in the process are the same up to the point when the tubing 150 exits from channel 83 in the left clamp set 81 and is further stopped by optional barrier 15. The jaw opening mechanism is adjusted such that once the tubing sensor 11 senses the tubing 150 as it is about to exit channel 20 in the sandwich 10, left jaw 80 only is activated so that it moves to the closed position just after the tubing exits channel 83 in the gripping body 50. Therefore, the left clamp set 81 grips the tubing securely and prevents any further advance while the right jaw 70 and right clamp set 71 remain in the cracked-open position to permit tubing to pass. The tube feeding station 130 is momentarily stopped while upper sandwich member 12 is caused to be elevated above lower sandwich member 14 by the method and apparatus previously described. There is now a gap between the two sandwich sections to permit additional tubing to be fed and located between them. The purpose of the two walls 17 and 19 is now apparent. They serve as barriers to prevent the excess tubing from spilling out over the sides of the sandwich. Since the tubing 150 will travel in the direction adjacent where the tubing exits, the movable wall 19 is not necessary, but is preferable. Tubing which is spilled out in this direction is not a problem. However, the wall adjacent the entry side of the tubing is necessary since this is the direction away from which the tubing 150 will move. In this embodiment, a short sandwich 10 whose channel depth in the radial direction can be approximately 3 inches and whose arc length can be approximately 6 to 10 inches can be used. Excess tubing 150 will spill out over the rear of the sandwich 10. The tube feeding station 130 is then once again activated and tubing 150 continues to be fed until a counter on the tube feeding station determines that the desired length of tubing has been fed. After the desired length of tubing 150 has been fed, right jaw 70 is caused to move to the closed position and the cut-off device 140 cuts the end of the tubing. If movable wall 19 is used, it is then caused to rotate to the horizontal position so that it is out of the horizontal path of movement of the tubing. The rotary indexing dial 108 then moves clockwise to the next position and the gripping member 50 once again carries the lengths of the tubing to the next station. It will be appreciated that if the direction of motion of the rotary indexing dial 108 was counterclockwise, the positions of the fixed and movable walls would be reversed. As mentioned, this embodiment is satisfactory for intermediate lengths of tubings, for example up to approximately 60 inches. If the tubing lengths are much longer than this, as the gripping member 50 indexes the tubing 150 around, the excess length of tubing 150 can become tangled in the machine or otherwise cause a problem. Therefore, it is necessary to provide a retaining means to hold and transport this excess length of tubing 150.

Therefore, if very long lengths of tubing 150 are required, an additional piece of apparatus, namely a pocket or tube retaining means is required. As shown in FIG. 10, the pocket 92 is attached to the lower surface 109 of the rotary indexing dial 108 at a location aligned with each gripping member 50 and radially inward thereof such that the front edge of each pocket 92 clears the rear face of the sandwich structure 10. In one preferred embodiment, the pocket 92 includes sides 93 and 94 which are radial and diverge downward. The sides 93 and 94 are inclined at an angle to the vertical. The tube retaining means 92 also contains a rear edge 95 which is inclined downwardly toward the center of the machine 100 and is also tangentially aligned, as shown in FIG. 10. The bottom 97 of the pocket 92 is a trap door which can be caused to swing downward to thereby permit the tubing to fall out of the pocket. In the preferred embodiment, the bottom 97 slopes downward toward the center of the machine. By way of example, the angle of the slope can be approximately 15 degrees. The bottom 97 is hinged to the rear surface 95 by hinges 98.

In this way, as excess tubing is fed from the tube feeding station 130, and the length becomes so great that it no longer is practical to have it hang down from the rear of the lower sandwich member 14, the excess tubing 150 falls into pocket 92 and is carried therein. The inward and downward slope of the pocket serves to assist the tubing in going into and being retained within the pocket 92. After the feeding process is completed and the tube is cut, the ends of the tube are once again carried by the gripping body 50 and the bulk of the excess length is carried by the pocket 92 as the tube 150 is rotated around by the indexing dial 108. Some length of tubing 150 extends between the gripping body 50 and the pocket 92. In this embodiment, it will be appreciated that there is one pocket 92 associated with each gripping body 50 and both are attached to the lower surface 109 of the rotary indexing dial 108 and rotate together with the dial.

The present invention therefore solves the most difficult part of the assembly process, namely handling flexible tubing, cutting it to the appropriate length, and assembling any multiplicity of objects such as the illustrated roller clamp onto the flexible tubing. After leaving the sandwich structure 10, the gripping body 50 then transports the assembled tubing to other stations, generally shown in FIG. 1. At these stations, objects are attached to the two ends of the tubing. By way of example, the two objects could be an injection site subassembly 156 and a tube drip chamber subassembly 154, both for use with intravenous feeding systems. After the parts are attached, the tube gripping member 50 indexes the parts to the discharge chute. The moveable jaws 70 and 80 are then moved to the opened position, the bottom 97 of the pocket 92 (if used) opens by its hinges 98, and the entire assembly is permitted to fall. The clamp stripper plate 180 helps to push the roller clamp 152 out of the spring loaded jaws 51. The entire assembly then falls down the chute 142 or 144 to either a container for removal or to another machine for further processing. An illustration of the completed assembly is shown in FIG. 11.

The overall invention has been described in great detail in order to comply with the patent statutes. In general, the invention can be divided into several parts. The first part of the invention is an improved method and apparatus for handling flexible tubing. This part of the invention involves the two part sandwich structure 10 which contains an interior channel or groove whose cross-sectional dimension is slightly larger than the cross-sectional dimension of the flexible material such as flexible tubing which is to be handled. The concept of the method is to provide the ability to push the flexible tubing by confining it so that it is not able to buckle. By confining the tubing or other flexible material in this manner, the tubing can be pushed and therefore easily handled in a mass production operation as previously described. The apparatus is basically a two part structure which incorporates the channel as just described. In its simplest form, the invention is simply the two part sandwich structure with the internal channel, which permits flexible tubing to be handled in a mass production operation. The groove or channel 20 has been described as being horseshoe shaped or arc shaped. This is in no way intended to limit the configuration of the channel or groove 20. The channel or groove 20 can be of any configuration including "S" shaped, for appropriate applications. The only limitation is that the channel or groove 20 should not have sharp right angle or comparable bends.

The second part of the invention incorporates the novel method and apparatus for gripping the tubing and attaching various components onto the tubing at any desired location. This involves the novel gripping members as set forth above with appropriate components such as the movable jaws which can be set to closed, cracked-open, and open positions. It also incorporates the novel spring loaded shelves or comparable apparatus which permit components such as the flow restrictor 152 to be aligned in the path of movement of the pushed tubing 150 so that the component is located at the place where it will be desired on the tubing 150 and the tubing 150 can be pushed through the component and also through the sandwich structure 10 or else first through the sandwich structure and then through the component or components. In this embodiment, the gripping members 50 are used in conjunction with the sandwich structure 10 as previously described.

The third part of the invention incorporates the use of variable sized sandwich structures with different lengths of grooves to permit the machine to be utilized with various sized lengths of tubing or different diameter grooves to be used with various sizes of cross-sectional diameter in different flexible material. In the specification, the portions of the sandwich structure have been described as members. They of course can also be considered to be first or upper section 12 and second or lower section 14.

The fourth part of the invention incorporates the use of the apparatus as described above, with the modified use of the gripping members to permit excess lengths of tubing to be fed after the lead end of the tubing is gripped and to further permit the excess lengths to be carried in the tube retaining means or pocket, as previously described.

All of the inventive concepts may be further modified or added to by the various optional apparatus previously described such as the stripper plate carrying knock-out pins, the fixed or movable side walls on the sandwich structure, the tube sensing device in the sandwich member, the barrier in front of the sandwich member, the pocket or tube retaining means and the clamp stripper plate.

In the preferred embodiment as described above, there is only one sandwich structure which is aligned in the tube feeding station. The sandwich structure 10 is fixed and does not rotate as the dial 108 indexes around. There are a multiplicity of gripping members which are attached to the dial and index around as the dial rotates. If the optional pockets are used, there is one pocket for each gripping member and it too is attached to the dial and indexes around with it. If a multiplicity of radially inwardly extending gripping members are utilized, then of course there is only one pocket associated with each set of radially inwardly extending gripping members.

In the preferred embodiment, the sandwich structure 10 is horizontally aligned, as previously described. It is also possible to align the sandwich in a vertically oriented position. By way of example, the sandwich structure 10 as described in FIGS. 2 and 10 could be rotated 90 degrees. The lower sandwich member 14 would now become the right sandwich member. The upper sandwich member 12 would now become the left sandwich member. When opening up, however, the left sandwich member would be divided into two parts, so that a portion would swing up and the other portion would swing down, to permit the completed tubing to be removed from the sandwich structure and index around the dial 108.

Of course, the present invention is not intended to be restricted to any particular form or arrangement, or any specific embodiment disclosed herein, or any specific use, since the same may be modified in various particulars or relations without departing from the spirit or scope of the claimed invention herein above shown and described of which the methods and apparatus shown are intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An apparatus to be used in conjunction with mass production machinery for moving and handling flexible tubing comprising:

a. a two part sandwich structure comprising an upper section and a lower section;

b. said upper section containing an internal groove beginning at a first opening and ending at a second opening, with both the first and second openings located on the front face of the upper section and spaced apart from each other;

c. the lower extremity of said groove protruding through the lower surface of said upper section such that the upper surface of said lower section forms the wall of the lowermost portion of said groove; and d. the cross-sectional size of said groove being only slightly larger than the cross-sectional size of the flexible tubing to be placed into the groove;

e. whereby said flexible tubing can be pushed through said groove thereby permitting said flexible tubing to be also pushed through components to be attached onto the flexible tubing and also permitting said flexible tubing to be pushed through gripping members which can hold the flexible tubing and permit objects to be placed on the ends of the flexible tubing.

2. The invention as defined in claim 1, wherein said internal groove is generally arc shaped.

3. An apparatus to be used in conjunction with mass production machinery for moving and handling flexible tubing comprising:

a. a stationary two part sandwich structure comprising a first section and a second section;

b. said first section containing an internal groove beginning at a first opening and ending at a second opening, with both the first and second openings located on the same face of the first section and spaced apart from each other;

c. one extremity of said internal groove protruding through the surface of said first section which is adjacent and comes in contact with a surface of said second section when the two sections of the two part sandwich structure are placed together to form the sandwich, such that the adjoining surface of said second section forms one wall of said internal groove;

d. the cross-sectional size of said internal groove in said two part sandwich structure being only slightly larger than the cross-sectional size of the flexible tubing to be moved and handled;

e. a multiplicity of gripping members located on the mass production machine, each of which contains a pair of moving jaws disposed adjacent opposite sides of each gripping member to form first and second moving jaws;

f. each moving jaw and the adjacent portion of a gripping member forming the opening of an internal groove which extends through the entire thickness of said gripping member to thereby form a first groove and a second groove in each gripping member;

g. the distance between the first and the second internal grooves in each gripping member being equal to the distance between said first opening and said second opening in said two part sandwich structure such that a respective groove in the gripping member and a respective opening of the groove in the two part sandwich structure are aligned when a gripping member is brought into alignment with the two part sandwich structure; and h. each of said gripping members being movable on said mass production machine such that a respective one of said gripping members can be brought into alignment with said stationary sandwich structure at any given time;

i. whereby a tube feeding apparatus can be caused to push flexible tubing through the first groove in said gripping member, into the first opening of said two part sandwich structure, through the internal groove in said two part sandwich structure, out the second opening in said two part sandwich structure and through the second groove in said gripping member, and to cut the flexible tubing just ahead of the first groove in the gripping member, to thereby permit the flexible tubing to be moved and handled in the mass production machine.

4. The invention as defined in claim 3, wherein said internal groove is generally arc shaped.

5. The invention as defined in claim 3 wherein said first section can be separated from said second section by mechanical actuating means to thereby permit said flexible tubing to be removed after it has passed through said gripping member and said groove in said two part sandwich structure.

6. The invention as defined in claim 5 further comprising:

a. a multiplicity of holes extending through the entire thickness of said first section of said two part sandwich structure and which are aligned with said internal groove in said two part sandwich structure and which are also adjacent said first opening and said second opening in said two part sandwich structure;

b. a stationary plate located at a distance from said first section to provide sufficient clearance for said first section when it is separated from said second section; and c. said stationary plate containing a multiplicity of knock-out pins, each of which is in alignment with a respective one of said multiplicity of holes in said first section of said two part sandwich structure;

d. whereby said knock-out pins enter a respective one of said holes in the first section of said two part sandwich structure when the first section is separated from the second section by mechanical actuating means to thereby assist in removing said flexible tubing from the internal groove in said two part sandwich structure.

7. The invention as defined in claim 3 wherein said two part sandwich structure contains tube sensing means which is in alignment with said internal groove in said two part sandwich structure and is adjacent said second opening in said two part sandwich structure to thereby signal the tube feeding apparatus to stop feeding tubing after said flexible tubing has exited said gripping member through the gripping member's second opening.

8. The invention as defined in claim 7 wherein the mass production machine contains a stationary barrier located in a position to be in front of each second groove in each gripping member when it is brought into alignment with said stationary two part sandwich structure, to thereby assist in stopping said flexible tubing when it exits the gripping member.

9. The invention as defined in claim 3 further comprising:

a. a jaw opening means located on the mass production machine;

b. said pair of moving jaws on each gripping member forming a first moving jaw which serves to open and close the first opening to the groove in said gripping member and a second moving jaw which serves to open and close the opening to the second groove in said gripping member; and c. said jaw opening means containing three settings which can cause said first moving jaw and said second moving jaw to be set in one of three positions, closed, cracked-open and open;

d. whereby when said first and second moving jaw are in the cracked-open position, flexible tubing can enter and pass through said first and second groove in said gripping means, when said first and second moving jaws are in the closed position, flexible tubing cannot move through the grooves and the moving jaws serve to grip the ends of the flexible tubing to thereby permit the gripping member to carry the flexible tubing as the gripping member is moved on the mass production machine, and when said first and second moving jaws are in the open position, the ends of the flexible tubing are permitted to fall out of the gripping member.

10. The invention as defined in claim 3 wherein each of said gripping members contains an opening to accommodate a component which can be fit into the opening and aligned with said first groove in said gripping member to thereby permit said flexible tubing to be pushed through said component as it is also being pushed through the gripping member and the two part sandwich structure.

11. The invention as defined in claim 3 wherein each of said gripping members contains an internal spring loaded shelf located behind said first movable jaw and the portion of said gripping member adjacent said first movable jaw whereby the spring loaded shelf can accommodate a roller clamp which is aligned with said first groove in said gripping member to thereby permit said flexible tubing to be pushed through said roller clamp as it is also being pushed through the gripping member and the two part sandwich structure.

12. The invention as defined in claim 3 wherein each of said gripping members contains an opening behind the first and second movable jaws to accommodate a component which can be fit into the opening and aligned with said first groove and said second groove in said gripping member to thereby permit said flexible tubing to be pushed through said component as it is also being pushed through the gripping member and the two part sandwich structure.

13. The invention as defined in claim 12 wherein a multiplicity of gripping members are placed in alignment with each other so that a multiplicity of components can be attached to the flexible tubing at various locations.

14. The invention as defined in claim 3 wherein said two part sandwich structure is horizontally disposed.

15. The invention as defined in claim 3 wherein said two part sandwich structure is vertically disposed.

16. The invention as defined in claim 3 wherein said internal groove in the two part sandwich is located between said first section and said second section of said two part sandwich structure and is only formed when said first and second sections of said sandwich structure are brought together and said first and second openings in said sandwich structure are also only formed when the two sections are brought together.

17. The invention as defined in claim 3 wherein said internal groove in the two part sandwich structure is located in said second section and the first and second openings are located in said second section of the sandwich structure.

18. An apparatus to be used in conjunction with mass production machinery for moving and handling flexible tubing comprising:

a. a stationary two part sandwich structure comprising a first section and a second section;

b. said first section containing an internal groove beginning at a first opening and ending at a second opening, with both the first and second openings located on the same face of the first section and spaced apart from each other;

c. one extremity of said internal groove protruding through the surface of said first section which is adjacent and comes in contact with a surface of said second section when the two sections of the two part sandwich structure are placed together to form the sandwich, such that the adjoining surface of said second section forms one wall of said internal groove;

d. the cross-sectional size of said internal groove in said two part sandwich structure being only slightly larger than the cross-sectional size of the flexible tubing to be moved and handled;

e. a multiplicity of gripping members located on the mass production machine, each of which contains a pair of moving jaws disposed adjacent opposite sides of each gripping member to form first and second moving jaws;

f. each moving jaw and the adjacent portion of a gripping member forming the opening of an internal groove which extends through the entire thickness of said gripping member to thereby form a first groove and a second groove in each gripping member;

g. said pair of moving jaws on each gripping member forming a first moving jaw which serves to open and close the opening to the first groove in said gripping member and a second moving jaw which serves to open and close the opening to the second groove in said gripping member;

h. the distance between the first and the second internal grooves in each gripping member being equal to the distance between said first opening and said second opening in said two part sandwich structure such that a respective groove in the gripping member and a respective opening of the groove in the two part sandwich structure are aligned when a gripping member is brought into alignment with the two part sandwich structure;

i. each of said gripping members being movable on said mass production machine such that a respective one of said gripping members can be brought into alignment with said stationary sandwich structure at any given time;

j. a multiplicity of tube receiving members located on the mass production machine, each of which is in alignment with a respective one of said gripping members and spaced apart from the gripping member to permit the stationary sandwich structure to come between a gripping member and a tube receiving means when they are brought into alignment with said two part sandwich structure;

k. mechanical actuating means to permit said first section to be separated from said second section;

l. a jaw opening means located on the mass production machine;

m. said jaw opening means containing three settings which can cause said first moving jaw and said second moving jaw to be set in one of three positions, closed, cracked-open and open; and n. a tube sensing means which is in alignment with said internal groove in said two part sandwich structure and is adjacent said second opening in said two part sandwich structure;

o. whereby when said jaw opening means causes said first and second jaws to be in the cracked-open position, a tube feeding apparatus can be caused to push flexible tubing through the first groove in said gripping member, into the first opening of said two part sandwich structure, through the internal groove in said two part sandwich structure, out the second opening in said two part sandwich structure and through the second groove in said gripping member and when said tube sensing means detects said flexible tubing, said second movable jaw is caused to move to the closed position to grip the leading end of the flexible tubing while said first jaw remains in the cracked open position and said mechanical actuating means causes said first section of said two part sandwich to be separated from the second section of the two part sandwich to thereby permit additional lengths of flexible tubing to be fed and to slide between the separate sandwich sections and slide into the tube receiving means until a predetermined amount of flexible tubing has been fed.

19. The invention as defined in claim 18, wherein said internal groove is generally arc shaped.

20. The invention as defined in claim 18 wherein said tube receiving means is a pocket which comprises:

a. a pair of side walls which are inclined at an angle to vertical;

b. a rear wall which adjoins the two side walls; and
c. a bottom which is downwardly sloped away from the two part sandwich structure and which is hinged on one side so that it may fall open.

21. An apparatus to be used in conjunction with mass production machinery for moving and handling flexible material comprising:

a. a two part sandwich structure comprising an upper section and a lower section;
b. said upper section containing an internal groove beginning at a first opening and ending at a second opening, with both the first and second openings located on the front face of the upper section and spaced apart from each other;
c. the lower extremity of said groove protruding through the lower surface of said upper section such that the upper surface of said lower section forms the wall of the lowermost portion of said groove; and
d. the cross-sectional size of said groove being only slightly larger than the cross-sectional size of the flexible material to be placed into the groove;
e. whereby said flexible material can be pushed through said groove thereby permitting said flexible material to be also pushed through components to be attached onto the flexible material and also permitting said flexible material to be pushed through gripping members which can hold the flexible material and permit objects to be placed on the ends of the flexible material.

22. The invention as defined in claim 21, wherein said internal groove is generally arc shaped.

23. An apparatus to be used in conjunction with mass production machinery for moving and handling flexible material comprising:

a. a stationary two part sandwich structure comprising a first section and a second section;
b. said first section containing an internal groove beginning at a first opening and ending at a second opening, with both the first and second openings located on the same face of the first section and spaced apart from each other;
c. one extremity of said internal groove protruding through the surface of said first section which is adjacent and comes in contact with a surface of said second section when the two sections of the two part sandwich structure are placed together to form the sandwich, such that the adjoining surface of said second section forms one wall of said internal groove;
d. the cross-sectional size of said internal groove in said two part sandwich structure being only slightly larger than the cross-sectional size of the flexible material to be moved and handled;
e. a multiplicity of gripping members located on the mass production machine, each of which contains a pair of moving jaws disposed adjacent opposite sides of each gripping member to form first and second moving jaws;
f. each moving jaw and the adjacent portion of a gripping member forming the opening of an internal groove which extends through the entire thickness of said gripping member to thereby form a first groove and a second groove in each gripping member;
g. the distance between the first and the second internal grooves in each gripping member being equal to the distance between said first opening and said second opening in said two part sandwich structure such that a respective groove in the gripping member and a respective opening of the groove in the two part sandwich structure are aligned when a gripping member is brought into alignment with the two part sandwich structure; and
h. each of said gripping members being movable on said mass production machine such that a respective one of said gripping members can be brought into alignment with said stationary sandwich structure at any given time;
i. whereby a flexible material feeding apparatus can be caused to push flexible material tubing through the first groove in said gripping member, into the first opening of said two part sandwich structure, through the internal groove in said two part sandwich structure, out the second opening in said two part sandwich structure and through the second groove in said gripping member, and to cut the flexible material just ahead of the first groove in the gripping member, to thereby permit the flexible material to be moved and handled in the mass production machine.

24. The invention as defined in claim 23, wherein said internal groove is generally arc shaped.

25. The invention as defined in claim 23 wherein said first section can be separated from said second section by mechanical actuating means to thereby permit said flexible material to be removed after it has passed through said gripping member and said groove in said two part sandwich structure.

26. The invention as defined in claim 25 further comprising:

a. a multiplicity of holes extending through the entire thickness of said first section of said two part sandwich structure and which are aligned with said internal groove in said two part sandwich structure and which are also adjacent said first opening and said second opening in said two part sandwich structure;
b. a stationary plate located at a distance from said first section to provide sufficient clearance for said first section when it is separated from said second section; and
c. said stationary plate containing a multiplicity of knock-out pins, each of which is in alignment with a respective one of said multiplicity of holes in said first section of said two part sandwich structure;
d. whereby said knock-out pins enter a respective one of said holes in the first section of said two part sandwich structure when the first section is separated from the second section by mechanical actuating means to thereby assist in removing said flexible material from the internal groove in said two part sandwich structure.

27. The invention as defined in claim 23 wherein said two part sandwich structure contains flexible material sensing means which is in alignment with said internal groove in said two part sandwich structure and is adjacent said second opening in said two part sandwich structure to thereby signal the flexible material feeding apparatus to stop feeding flexible material after said flexible material has exited said gripping member through the gripping member's second opening.

28. The invention as defined in claim 27 wherein the mass production machine contains a stationary barrier located in a position to be in front of each second groove in each gripping member when it is brought into alignment with said stationary two part sandwich structure, to thereby assist in stopping said flexible material when it exits the gripping member.

29. The invention as defined in claim 25 further comprising:

a. a jaw opening means located on the mass production machine;

b. said pair of moving jaws on each gripping member forming a first moving jaw which serves to open and close the first opening to the groove in said gripping member and a second moving jaw which serves to open and close the opening to the second groove in said gripping member; and c. said jaw opening means containing three settings which can cause said first moving jaw and said second moving jaw to be set in one of three positions, closed, cracked-open and open;

d. whereby when said first and second moving jaw are in the cracked-open position, flexible material can enter and pass through said first and second groove in said gripping means, when said first and second moving jaws are in the closed position, flexible material cannot move through the grooves and the moving jaws serve to grip the ends of the flexible material to thereby permit the gripping member to carry the flexible material as the gripping member is moved on the mass production machine, and when said first and second moving jaws are in the open position, the ends of the flexible material are permitted to fall out of the gripping member.

30. The invention as defined in claim 23 wherein each of said gripping members contains an opening to accommodate a component which can be fit into the opening and aligned with said first groove in said gripping member to thereby permit said flexible material to be pushed through said component as it is also being pushed through the gripping member and the two part sandwich structure.

31. The invention as defined in claim 23 wherein each of said gripping members contains an internal spring loaded shelf located behind said first movable jaw and the portion of said gripping member adjacent said first movable jaw whereby the spring loaded shelf can accommodate a roller clamp which is aligned with said first groove in said gripping member to thereby permit said flexible material to be pushed through said roller clamp as it is also being pushed through the gripping member and the two part sandwich structure.

32. The invention as defined in claim 23 wherein each of said gripping members contains an opening behind the first and second movable jaws to accommodate a component which can be fit into the opening and aligned with said first groove and said second groove in said gripping member to thereby permit said flexible material to be pushed through said component as it is also being pushed through the gripping member and the two part sandwich structure.

33. The invention as defined in claim 32 wherein a multiplicity of gripping members are placed in alignment with each other so that a multiplicity of components can be attached to the flexible material at various locations.

34. The invention as defined in claim 23 wherein said two part sandwich structure is horizontally disposed.

35. The invention as defined in claim 23 wherein said two part sandwich structure is vertically disposed.

36. The invention as defined in claim 23 wherein said internal groove in the two part sandwich is located between said first section and said second section of said two part sandwich structure and is only formed when said first and second sections of said sandwich structure are brought together and said first and second openings in said sandwich structure are also only formed when the two sections are brought together.

37. The invention as defined in claim 23 wherein said internal groove in the two part sandwich structure is located in said second section and the first and second openings are located in said second section of the sandwich structure.

38. An apparatus to be used in conjunction with mass production machinery for moving and handling flexible material comprising:

a. a stationary two part sandwich structure comprising a first section and a second section;

b. said first section containing an internal groove beginning at a first opening and ending at a second opening, with both the first and second openings located on the same face of the first section and spaced apart from each other;

c. one extremity of said internal groove protruding through the surface of said first section which is adjacent and comes in contact with a surface of said second section when the two sections of the two part sandwich structure are placed together to form the sandwich, such that the adjoining surface of said second section forms one wall of said internal groove;

d. the cross-sectional size of said internal groove in said two part sandwich structure being only slightly larger than the cross-sectional size of the flexible material to be moved and handled;

e. a multiplicity of gripping members located on the mass production machine, each of which contains a pair of moving jaws disposed adjacent opposite sides of each gripping member to form first and second moving jaws;

f. each moving jaw and the adjacent portion of a gripping member forming the opening of an internal groove which extends through the entire thickness of said gripping member to thereby form a first groove and a second groove in each gripping member;

g. said pair of moving jaws on each gripping member forming a first moving jaw which serves to open and close the opening to the first groove in said gripping member and a second moving jaw which serves to open and close the opening to the second groove in said gripping member;

h. the distance between the first and the second internal grooves in each gripping member being equal to the distance between said first opening and said second opening in said two part sandwich structure such that a respective groove in the gripping member and a respective opening of the groove in the two part sandwich structure are aligned when a gripping member is brought into alignment with the two part sandwich structure;

i. each of said gripping members being movable on said mass production machine such that a respective one of said gripping members can be brought into alignment with said stationary sandwich structure at any given time;

j. a multiplicity of flexible material receiving members located on the mass production machine, each of which is in alignment with a respective one of said gripping members and spaced apart from the gripping member to permit the stationary sandwich structure come between a gripping member and a flexible material receiving means when they are brought into alignment with said two part sandwich structure;

k. mechanical actuating means to permit said first section to be separated from said second section;

l. a jaw opening means located on the mass production machine;

m. said jaw opening means containing three settings which can cause said first moving jaw and said second moving jaw to be set in one of three positions, closed, cracked-open and open; and n. a flexible material sensing means which is in alignment with said internal groove in said two part sandwich structure and is adjacent said second opening in said two part sandwich structure;

o. whereby when said jaw opening means causes said first and second jaws to be in the cracked-open position, a flexible material feeding apparatus can be caused to push flexible material through the first groove in said gripping member, into the first opening of said two part sandwich structure, through the internal groove in said two part sandwich structure, out the second opening in said two part sandwich structure and through the second groove in said gripping member and when said flexible material sensing means detects said flexible material, said second movable jaw is caused to move to the closed position to grip the leading end of the flexible material while said first jaw remains in the cracked open position and said mechanical actuating means causes said first section of said two part sandwich to be separated from the second section of the two part sandwich to thereby permit additional lengths of flexible material to be fed and to slide between the separate sandwich sections and slide into the flexible material receiving means until a predetermined amount of flexible material has been fed.

39. The invention as defined in claim 38, wherein said internal groove is generally arc shaped.

40. The invention as defined in claim 38 wherein said flexible material receiving means is a pocket which comprises:

a. a pair of side walls which are inclined at an angle to vertical;

b. a rear wall which adjoins the two side walls; and c. a bottom which is downwardly sloped away from the two part sandwich structure and which is hinged on one side so that it may fall open.

* * * * *